United States Patent [19]

Scott et al.

[11] 4,024,818

[45] May 24, 1977

[54] STAB-INITIATED EXPLOSIVE DEVICE CONTAINING A SINGLE EXPLOSIVE CHARGE

[75] Inventors: Calvin L. Scott, Washington, D.C.; Howard S. Leopold, Silver Spring, Md.

[73] Assignee: The United States of America as represented by the Secretary of the Navy, Washington, D.C.

[22] Filed: Mar. 16, 1976

[21] Appl. No.: 667,816

[52] U.S. Cl. ..... 102/27 R; 102/86.5; 149/23

[51] Int. Cl.[2] ..... C06C 5/00; C06C 7/00; C06B 41/00

[58] Field of Search ..... 102/27 R, 86.5; 149/23, 149/88; 260/299, 308 R, 308 D

[56] References Cited

UNITED STATES PATENTS

| | | | |
|---|---|---|---|
| 2,004,719 | 6/1935 | Brun | 149/23 |
| 2,066,954 | 1/1937 | Herz | 149/23 |
| 2,857,847 | 10/1958 | Seavey | 102/86.5 |
| 3,173,921 | 3/1965 | Einberg | 149/23 |
| 3,186,341 | 6/1965 | Bjorklund | 102/86.5 |
| 3,499,386 | 3/1970 | Stadler | 102/86.5 |
| 3,688,702 | 9/1972 | Prior | 102/86.5 |
| 3,965,951 | 6/1976 | Scott | 149/23 |

FOREIGN PATENTS OR APPLICATIONS

| | | | |
|---|---|---|---|
| 55,567 | 4/1927 | Austria | 102/46 |
| 185,555 | 9/1922 | United Kingdom | 149/23 |
| 384,608 | 12/1932 | United Kingdom | 149/23 |

*Primary Examiner*—Samuel W. Engle
*Assistant Examiner*—Donald P. Walsh
*Attorney, Agent, or Firm*—R. S. Sciascia; A. L. Branning; H. B. Field

[57] ABSTRACT

An explosive device having utility as a stab-initiated detonator or primer which comprises a container for housing an explosive charge, and a single explosive charge consisting of from about 90 percent to about 98 percent by weight of mercuric-5-nitrotetrazole and from about 2 percent to about 10 percent by weight of tetracene, housed within the container.

2 Claims, No Drawings

STAB-INITIATED EXPLOSIVE DEVICE CONTAINING A SINGLE EXPLOSIVE CHARGE

BACKGROUND OF THE INVENTION

The present invention relates to explosive devices, and more specifically to stab-initiated detonators or primers which contain a single explosive charge, namely, a uniform mixture of a major amount of mercuric-5-nitrotetrazole and a minor amount of tetracene.

It has been the general practice in the explosive arts to employ three different explosive charges of varying sensitivity in the design of conventional stab-initiated detonators. These charges are typically an ignition charge which posses the requisite stab sensitivity for initiating the detonator, an intermediate charge which builds rapidly from burning to detonation and which is positioned adjacent to the ignition charge, and a less sensitive but more powerful base charge which has a detonation velocity greater than that of the ignition or intermediate charges and which is positioned adjacent to the intermediate charge.

An example of an ignition charge which is typically employed in stab-initiated detonators is a primary mixture composed of 40% basic lead styphnate, 20% barium nitrate, 20% lead azide 15%, antimony sulphide and 5% tetracene. Another commonly used ignition charge is priming mixture composed of 33.4% potassium perchlorate, 33.3% antimony sulphide, 28.3% lead azide, and 5.0% carborundum. Intermediate charges which are commonly used in stab-initiated detonators are dextrinated lead azide, or lead azide (PVA) which is lead azide that has been precipitated in the presence of polyvinyl alcohol. Conventional base charges for stab-initiated detonators include 2,4,6,N-tetranitromethylaniline (tetryl), pentaerythritol tetranitrate (PETN) and cyclotrimmethylenetrinitramine (RDX).

One disadvantage of using three separate charges in the construction of detonators is that they must be placed in a definite order of varying sensitivity within a cup or container. Where loading of these containers is done on a large scale and there are many charges of varying sensitivity used in loading, errors could obviously arise in the order of sensitivity in which these charges are packed in the container, and such errors in turn would cause a misfiring, or render the detonator inoperative.

Another disadvantage in using three components in a single detonator is that the sensitivities and component lengths of the ignition charge, the intermediate charge and the base charge must be predetermined in relation to one another to optimize the explosive transition from the very sensitive primary charge to the less sensitive base charge.

In the past, attempts have been made to reduce the number of separate explosive charges present in detonators of various types. For example, see U.S. Pat. No. 1,968,134 to Eschbach et al. and U.S. Pat. No. 3,340,808 to Leopold. However, none of the efforts disclosed in the prior art have led to the successful development of a stab-initiated detonator employing a single explosive charge.

Thus, the general purpose of the present invention is to provide a stab-initiated detonator employing a single explosive charge which is comparable in stab sensitivity and output to three component prior art detonators, and which possesses none of the aforementioned disadvantages of three component detonators. A detonator employing a single explosive charge will result in a decrease in the number of charges needed, as compared to prior art stab-initiated detonators. The determination of appropriate column lengths for the various charges, as mentioned above, will be obviated. Loading errors will be totally eliminated. The loading time involved in manufacturing stab initiated detonators will be greatly reduced, and the overall manufacturing procedure will be simplified.

SUMMARY OF THE INVENTION

Accordingly, it is an object of the present invention to provide a stab-initiated detonator employing a single explosive charge having stab sensitivity and output comparable to stab-initiated detonators containing a plurality of explosive charges.

A further object of the invention is to provide a stab-initiated detonator which is easy to load and which is not subject to the loading errors that arise in the construction of detonators containing a plurality of explosive charges.

DESCRIPTION OF THE PREFERRED EMBODIMENTS

It has now been discovered that a stab-initiated detonator containing a single explosive charge can be construed having stab sensitivity and output comparable to prior art stab-initiated detonators containing a plurality of explosive charges. The stab-initiated detonator of the present invention is composed of a container for housing an explosive charge, and a single explosive charge consisting of from about 90 percent to about 98 percent by weight of mercuric-5-nitrotetrazole and from about 2 percent to about 10 percent by weight of tetracene housed within the container.

The container for the detonator, referred to in the art as a cup, is typically a metal cylinder having openings at either end. The openings are generally smaller in diameter than the inside diameter of the cylinder. Metal discs are often inserted in the ends of the container to cover the openings. The metal disc at the end opposite the stabbing means is generally relatively thick. The metal disc adjacent to the stabbing means must be thin enough to permit the stabbing means to penetrate the disc and contact the explosive charge with sufficient force to initiate the explosive charge.

The container may also be fabricated with a closed end. The closed end may be machined to a thinness which will readily permit penetration by the stabbing means.

The metals from which the container is usually fabricated are aluminum, copper sheet, stainless steel and gilding metal, which is a high-copper red brass containing 90 to 97 percent copper with the remainder being zinc. For certain applications, the container material may be a cellulose derivative as disclosed in U.S. Pat. No. 3,121,394 to Anzalone, or a dimensionally stable synthetic polymer.

While the geometrical configuration of the container is normally cylindrical, other configurations may also be used.

During the course of the research directed toward the development of a single component stab-initiated detonator it was discovered that when mercuric-5-nitrotetrazole is employed as the single charge in a stab-initiated detonator the output of the detonator is comparable to the output of a standard three component stab-initiated detonator containing a priming mix composed of 40% basic lead styphnate, 20% bariumm nitrate, 20% lead azide, 15% antimony sulphide and 5% tetracene, as the ignition charge, lead azide (PVA), as the intermediate charge, and RDX, as the base charge. Table I contains a comparison of the output of the two stab-initiated detonators described above.

Table I

| Detonator containing Mercuric-5-Nitrotetrazole | | Three Component Detonator* | |
|---|---|---|---|
| Dent in Steel Block (MILS) | Loading Pressure (PSI) | Dent in Steel Block (MILS) | Loading Pressure (PSI) |
| 20 | 15 | 20 | 15 |
| 20.5 | 30 | 20.5 | 30 |
| 22 | 45 | 20.5 | 45 |
| 21 | 60 | 17 | 60 |

*Component No. 1 = Priming mix of: 40% Basic Lead Styphnate, 20% Barium Nitrate, 20% Lead Azide, 15% Antimony Sulphide, and 5% Tetracene.
Component No. 2 = Lead Azide (PVA)
Component No. 3 = RDX Output is determined by measuring the depth of the dent produced by initiating the detonator on top of a steel block. The procedure for measuring output involves filling the detonator cup with the explosive charge or charges, as the case may be, and placing it on a steel block with the end of the detonator containing the base charge resting on the steel block. Next, a brass sleeve is placed around the detonator. Then, a plastic adapted is placed over the brass sleeve. The adapter is designed to permit a firing pin to descend upon the end of the detonator containing the ignition charge.

Althouogh the output of the stab-initiated detonator containing mercuric-5-nitrotetrazole was found to be comparable to the three component detonator, it was discovered that the stab-sensitivity of the former was substantially less than the stab-sensitivity of the ignition charge used in the latter. Table II contains a comparison of the stab sensitivity of mercuric-5-nitrotetrazole and a priming mixture containing 40% basic lead styphnate, 20% barium nitrate, 20% lead azide, 15% antimony sulphide, and 5% tetracene.

TABLE II

| Mercuric-5-Nitrotetrazole | | Priming Mix | |
|---|---|---|---|
| Energy for 50% Initiation (inch-ounces) | Loading Pressure (PSI) | Energy for 50% Initiation (inch-ounces) | Loading Pressure (PSI) |
| 11.3 | 20 | 1.8 | 20 |
| 8.9 | 40 | 1.3 | 40 |
| 6.2 | 60 | 1.0 | 60 |

However, when 5 percent of tetracene was added to the mercuric-5-nitrotetrazole it was found that the stab-sensitivity of the resultant mixture had increased significantly, and yet the output of the mixture was compared to pure mercuric-5-nitrotetrazole was virtually unchanged. The stab-sensitivity of the mixture containing 95% mercuric-5-nitrotetrazole and 5% tetracene is shown in Table III.

TABLE III

| 95% Mercuric-5-Nitrotetrazole and 5% Tetracene | |
|---|---|
| Energy for 50% Initiation (inch-ounces) | Loading Pressure (PSI) |
| 2.4 | 20 |
| 2.2 | 40 |
| 1.8 | 60 |

The mercuric-5-nitrotetrazole used in the detonators of the present invention has the following structural formula:

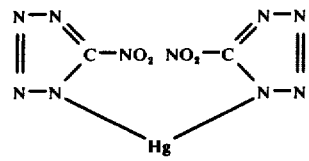

It may be prepared according to the method disclosed by von Herz in U.S. Pat. No. 2,066,954.

The mixture containing 95% mercuric-5-nitrotetrazole and 5% tetracene represents the preferred composition of the single explosive charge for use in the stab-initiated detonator of the present invention. However, the percentages of the two components may vary. For example, the mercuric-5-nitrotetrazole may be present in an amount between about 90 percent and about 98 percent by weight, and the amount of tetracene may be adjusted accordingly between about 2 percent and about 10 percent by weight based on the total weight of the explosive charge.

The single explosive charged described hereinabove may also be employed in a single component stab-initiated primer.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A stab-initiating detonating or priming device comprising a container for housing an explosive charge, and a single explosive charge consisting of a uniform mixture of from about 90 percent to about 98 percent by weight of mercuric-5-nitrotetrazole and from about 2 percent by weight of tetracene housed within said container.

2. The detonating or priming device of claim 1 wherein the single explosive charge consists of 95 percent of mercuric-5-nitrotetrazole and 5 percent of tetracene.

* * * * *